United States Patent [19]

Morishita et al.

[11] Patent Number: 4,648,150

[45] Date of Patent: Mar. 10, 1987

[54] VACUUM CLEANER

[75] Inventors: Takuya Morishita, Himeji; Akihiko Kurioka, Hyogo; Akihiro Morita, Kakogawa, all of Japan

[73] Assignee: Sanyo Electric Co., Ltd., Japan

[21] Appl. No.: 797,824

[22] Filed: Nov. 14, 1985

[30] Foreign Application Priority Data

Nov. 20, 1984 [JP] Japan ..... 59-176898[U]
Jul. 4, 1985 [JP] Japan ..... 60-102211[U]
Jul. 11, 1985 [JP] Japan ..... 60-105755[U]

[51] Int. Cl.[4] ..... A47L 5/10

[52] U.S. Cl. ..... 15/389; 15/391; 15/390

[58] Field of Search ..... 15/389, 391, 390, 331, 15/332, 333

[56] References Cited

U.S. PATENT DOCUMENTS 3,757,382 9/1973 Brooks ..... 15/389
4,245,370 1/1981 Baker ..... 15/391
4,317,253 5/1982 Gut ..... 15/390
4,328,522 5/1982 Tryan ..... 15/391
4,370,690 1/1983 Baker ..... 15/391
4,446,595 5/1984 Nakada et al. ..... 15/390

FOREIGN PATENT DOCUMENTS 3204272 8/1983 Fed. Rep. of Germany ..... 15/390

*Primary Examiner*—Werner H. Schroeder
*Assistant Examiner*—Mary A. Ellis
*Attorney, Agent, or Firm*—Darby & Darby

[57] ABSTRACT

A vacuum cleaner comprising a dust intake portion, a rotary brush provided in the intake portion, a drive motor for driving the rotary brush, a fan motor for suction of dust, a dust collector for the dust taken in, a dust transfer passage extending from the intake portion to the dust collector, a rotary brush pulley, a drive motor pulley, a belt coupling the above mentioned two pulleys for transmitting the power of the drive motor, at least one of the pulleys being frustoconical, and drive motor stopping means disposed at one side of the belt toward which said one pulley is diametrically smaller and pushable by the belt when the belt is displaced, which can provide to surely protect the belt and the drive motor for driving the rotary brush even if the rotary brush becomes stalled.

12 Claims, 9 Drawing Figures

VACUUM CLEANER

BACKGROUND OF THE INVENTION

1. Field of the Invention

The present invention relates to improvements in vacuum cleaners having a rotary brush in the dust intake opening portion.

2. Prior Art

With vacuum cleaners having a rotary brush in the dust intake opening portion, it is likely that a carpet or the like will be caught by the rotary brush to stall the brush during cleaning. If the motor for driving the brush continues to rotate in this state, the motor pulley rubs against the stopped belt, producing heat of friction to break the belt. Furthermore, the drive motor, which is also overloaded, will burn out.

To eliminate the above drawback, Unexamined Japanese Patent Publication No. SHO 58-86121 discloses a cleaner wherein when the rotary brush becomes stalled, a clutch provided between the brush and the drive motor therefor operates to turn off a switch and stop the motor, whereby the belt is prevented from breaking. However, the cleaner is inefficient and very costly to fabricate and has a likelihood of malfunction because of its complex structure including the clutch and two belts.

U.S. Pat. No. 3,757,382 discloses an arrangement which is adapted to reduce the friction between the rotary brush pulley and the belt when the rotary brush becomes stalled. Nevertheless, the arrangement is complex in construction and requires a cumbersome and costly procedure for fabrication because the pulley comprises a plurality of rollers.

Unexamined Japanese Patent Publication No. SHO 59-192321 discloses an arrangement wherein the drive motor for the rotary brush is supported by an elastic body to tilt the motor and thereby shift the belt when the brush is stalled, such that the shift of the belt is detected to stop the motor. However, it is extremely difficult to adjust the degree of elasticity with which the motor is supported tiltably, because if supported too rigidly, the motor will not tilt, whereas if supported too elastically, the motor will be unstable at all times.

SUMMARY OF THE INVENTION

The present invention provides a vacuum cleaner which comprises a dust intake portion, a rotary brush provided in the intake portion, a drive motor for driving the rotary brush, a fan motor for suction of dust, a dust collector for the dust taken in, a dust transfer passage extending from the intake portion to the dust collector, a rotary brush pulley, a drive motor pulley, a belt coupling the above mentioned two pulleys for transmitting the power of the drive motor, at least one of the pulleys being frustoconical and drive motor stopping means disposed at one side of the belt toward which said one pulley is diametrically smaller and pushable by the belt when the belt is displaced.

An object of the present invention is to provide a vacuum cleaner in which the belt will not break or the rotary brush drive motor will not burn out when the rotary brush becomes stalled.

Another object of the invention is to provide a rotary brush drive motor stopping mechanism which is simple in construction, inexpensive and reliably operable when the rotary brush becomes stalled.

The expression that the pulley is frustoconical as used herein means that the pulley has a diameter gradually decreasing from one end toward the other end with such a taper that when the rotary brush is stalled, the belt as subjected to increased tension can be displaced. When the taper is too small, it is difficult to effect the displacement, whereas too large a taper results in unsable power transmission during usual operation. Preferably, the taper is 4/25 to 5/25.

The side of the belt toward which the pulley is made diametrically smaller may be a suitable side. However, when the means for stopping the rotary brush drive motor is disposed adjacent to the drive motor, the pulley is tapered toward the motor side.

The drive motor stopping means of the present invention needs only to be one which functions to stop the drive motor directly or indirectly. For example, the means which functions to stop the motor directly is a stop switch connected in series with the drive motor. The means having an indirect stopping function comprises a switch for turning on an alarm lamp for urging the user to stop the drive motor.

When the direct stop switch is used, lock means is preferably used in combination therewith to avoid the hazard to be involved in handling. The lock means, when used, requires release means therefor. Thus, the lock means, which may be a mechanical or electrical suitable one, is used conjointly with a suitable release means in corresponding relation thereto. For example, when a magnet is used as the lock means, the release means comprises a mechanism for mechanically releasing a switch lever out of contact with the magnet.

When displaced, the belt is returned to the original position on the pulley by return means. The release means may be made serviceable also as the return means.

When the fan motor is disposed in the vicinity of the rotary brush, the fan motor may serve also as the drive motor for the rotary brush.

BRIEF DESCRIPTION OF THE DRAWINGS

FIG. 1 is a side elevation;

FIG. 2 is a cross sectional view;

FIG. 3 is a view in section taken along the line X—X in FIG. 2;

FIG. 4 is a fragmentary plan view;

FIG. 5 is a fragmentary electric circuit diagram;

FIG. 6 is a view in section taken along the line Y—Y in FIG. 2;

DESCRIPTION OF THE PREFERRED EMBODIMENTS

An embodiment of the present invention will be described below.

Figure 1:
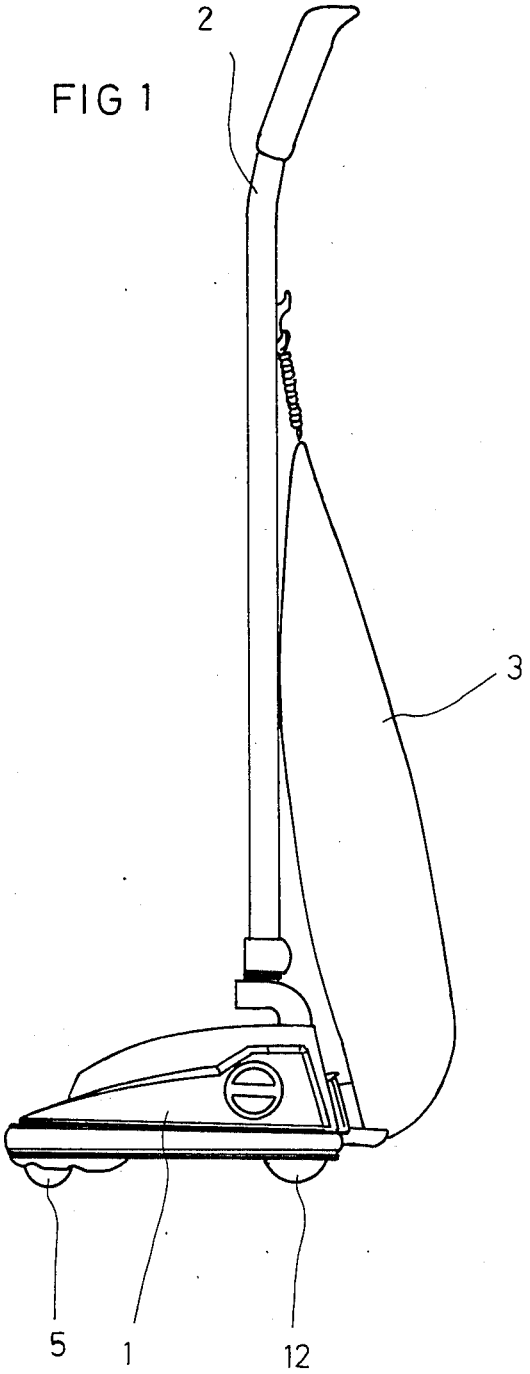
FIGS. 1 to 6 show a vacuum cleaner embodying the present invention.

With reference to FIG. 1, an upright vacuum cleaner comprises a cleaner main body 1, a handle 2 and a dust collector 3. The handle 2 is pivoted to a rear portion of the main body 1. The dust collector 3 is in the form of a bag and communicates at its lower end with the interior of the main body 1.

Figure 2:
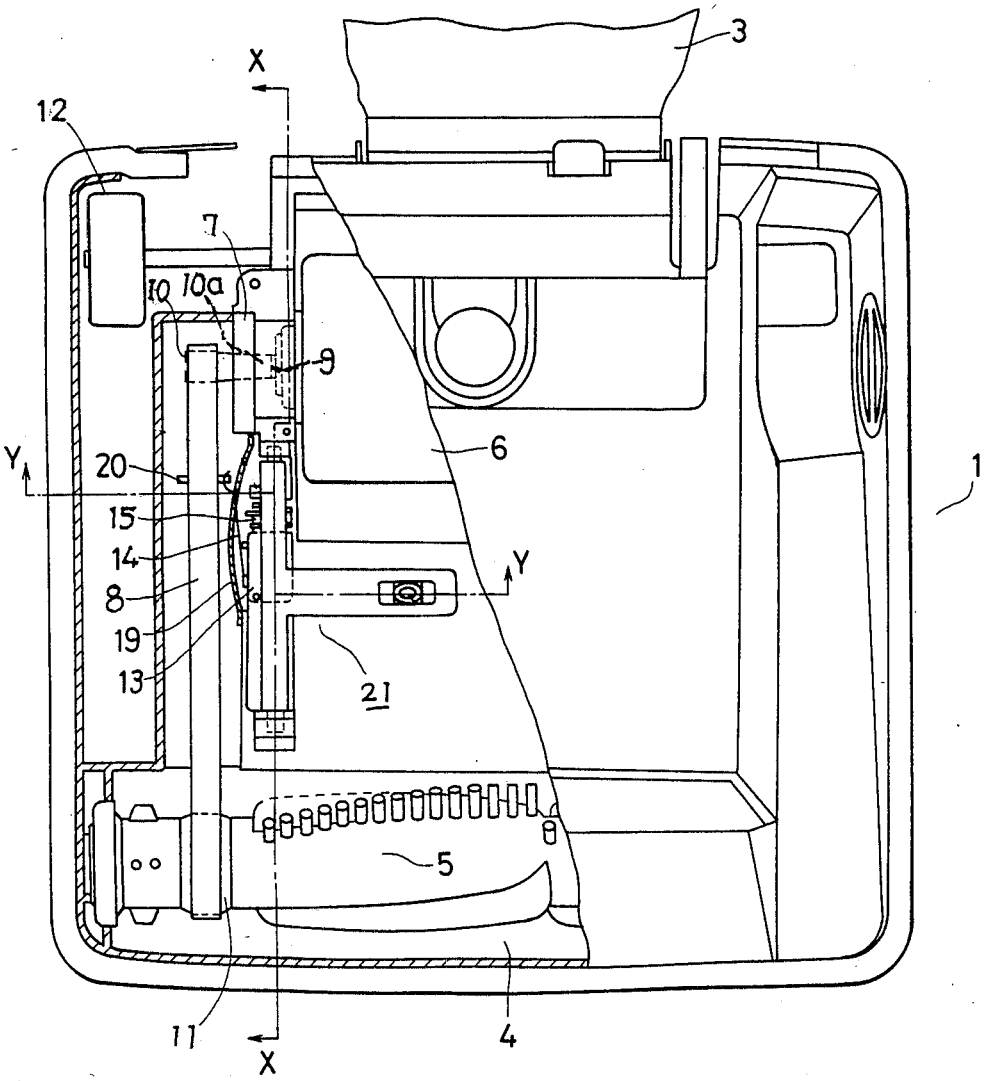
Figure 3:
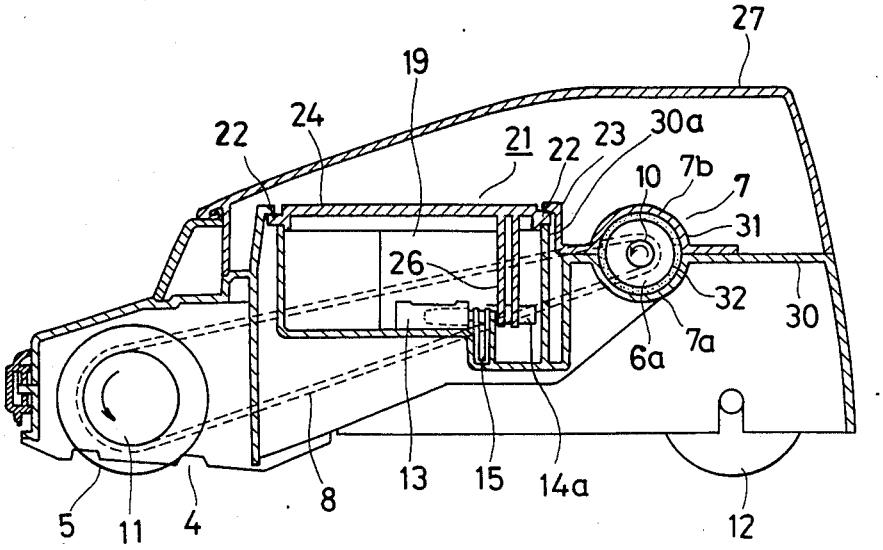

Referring to FIGS. 2 and 3, indicated at 4 is an intake opening formed in the front portion of the bottom of the main body 1, and at 5 a rotary brush provided in the intake opening 4 for removing dust from carpets, floors, etc. A fan motor 6 supported by a holder 7 and serving also as a drive motor for the rotary brush 5 is provided with a fan (not shown) positioned in an air passage (not shown). The other end of the air passage is open at a rear portion of the main body 1. The dust collector 3 is connected to the open end. A belt 8 for transmitting a drive force to the rotary brush 5 couples a drive pulley 10 and a driven pulley 11 mounted on the rotary shaft 9 of the fan motor 6 and one end of the brush 5, respectively. Indicated at 12 are wheels (only one shown) arranged at opposite sides of the main body 1 at its rear portion.

With the vacuum cleaner thus constructed, the fan motor 6, when operated, rotates the brush 5, whereby dust is removed from a carpet or floor surface and then led into the dust collector 3 via the air passage.

Figure 4:
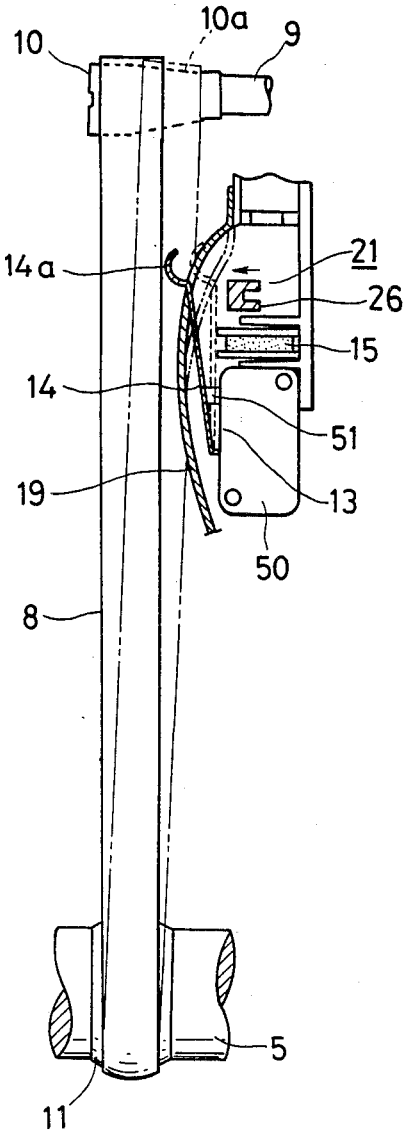

As shown in FIG. 4, the pulley 10 on the fan motor 6 is frustoconical, with its diameter gradually decreasing axially thereof. The pulley 10 has a taper (the decrease of the diameter relative to the length) of 5/25, which serves the following function.

When the rotary brush 5 becomes stalled, the belt 8 slips over the pulley 11 and is subjected to increased tension, with the result that the belt 8 is displaced along the tapered surface of the pulley 10 toward its small-diameter portion 10*a* as indicated in broken lines in FIG. 4. To cause the displacement of the belt 8, the pulley 11, instead of the pulley 10, may be tapered, or both the pulleys 10 and 11 may be tapered to a lesser degree. The displacement of the belt 8 is detected by a stop switch 13 which is disposed at one side of the belt 8 toward the small-diameter portion 10*a* of the pulley 10. The stop switch 13 comprises a metal lever 14 and a microswitch 50 having a push portion 51. When displaced, the belt 8 pushes the metal lever 14 from solid-line position to broken-line position in FIG. 4, causing the lever 14 to press the push portion 51. The lever 14 is locked in the broken-line position by being attracted to a permanent magnet (lock means) 15. Even if the belt 8 thereafter returns to its original position, the lever 14 is held in the attracted locked position in pressing contact with the push portion 51 of the microswitch 50. This eliminates the likelihood that the fan motor 6 will rotate inadvertently.

Figure 5:
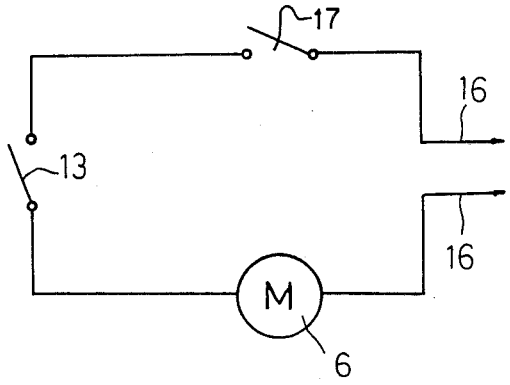

As shown in FIG. 5, the stop switch 13 is connected to power supply terminals 16, 16 in series with the fan motor 6. Upon detecting the displacement of the belt 8, the switch 13 opens to de-energize the fan motor 6. A mannual operation switch 17 is also connected in series with the stop switch 13.

Figure 6:
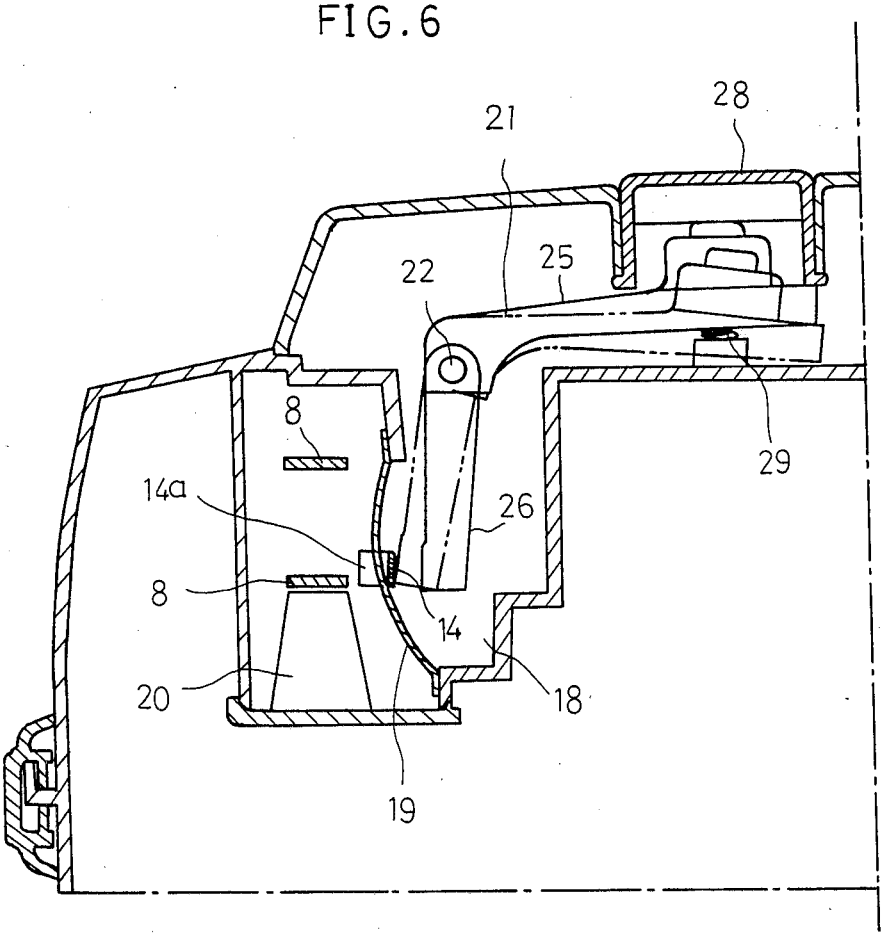

The stop switch 13 is accommodated in a space 18, which is separated off by a diaphragm (film) 19 to prevent ingress of dust as seen in FIG. 6. The lever 14 has a sensor portion 14*a* extending through the diaphragm 19. In the vicinity of the pulley 10, a rib-like stopper 20 is disposed under the belt 8 for limiting the displacement of the belt 8.

With reference particularly to FIGS. 2, 3 and 6, the vacuum cleaner has a re-start arm (release-return means) 21, by which the belt 8 is pushed back from the displaced position to the normal running position. The holder 7 for the fan motor 6 is integrally formed with a bearing portion 23 for a pivot 22 of the re-start arm 21. The restart arm 21 comprises a stem 24 having pivots 22, 22 projecting from its opposite ends, a handle portion 25 extending horizontally from the stem 24 and a pushing portion 26 extending downward from the stem 24. These portions 24, 25, 26 are U-shaped in cross section and are molded integrally of synthetic resin or the like. When the re-start arm 21 is manipulated by depressing a push button 28 after removing an upper case 27 of the main body 1, the arm 21 turns clockwise against a return spring 29 as indicated in broken lines in FIG. 6, causing the pushing portion 26 to push the lever 14 out of contact with the permanent magnet 15, whereupon the lever 14 returns the belt 8 to the normal position. The holder 7 comprises a downwardly curved portion 7*a* included in a lower case 30 of the main body 1 and having a semicircular cross section, and a strip 31 including an upwardly curved portion 7*b* corresponding to the portion 7*a*, the strip 31 being fastened to the lower case 30 by screws.

The holder 7 holds a projecting end portion 6*a* of the fan motor 6 with a cushion member 32 provided therebetween. The bearing portion 23 is integral with an edge portion of the holder 7, is curved around the pivot 22 and presses the pivot 22 against a recessed portion of a lower case wall 30*a*. With the arrangement described, the holder 7 and the bearing portions 23 are positioned close to the pulley 10 on the fan motor 6, so that the parts concerned are in a compacted arrangement. Furthermore, the re-start arm can be accurately positioned relative to the motor holder, to the fan motor, to the drive pully on the fan motor, and to the belt coupling the two pulleys. The belt can therefore be returned from its displaced position to the proper position with high precision by the re-start arm which is thus positioned accurately.

The fan motor stopping means of the foregoing embodiment comprises the stop switch, lock means and release (return) means, whereas the stopping means may comprise the stop switch only as a minimum component.

Figure 7:
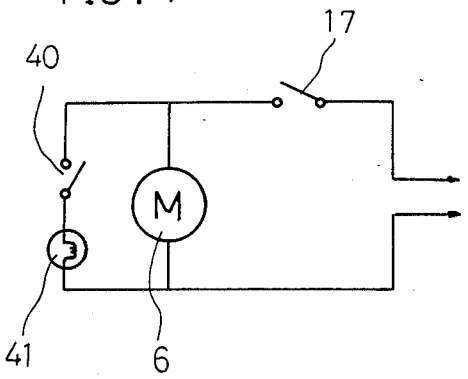
FIG. 7 is a diagram corresponding to FIG. 5 and showing another embodiment.

Although the stop switch of the stopping means according to the above embodiment stops the fan motor 6 directly, the stopping means may alternatively be one for stopping the motor indirectly as seen in FIG. 7. In this case, a switch 40 serving as the stopping means is closed to flicker an alarm lamp 41. Upon recognizing that the alarm lamp 41 is on, the user stops the fan motor 6 by the operation switch 17. This embodiment does not require the lock means or release means.

Figure 8:
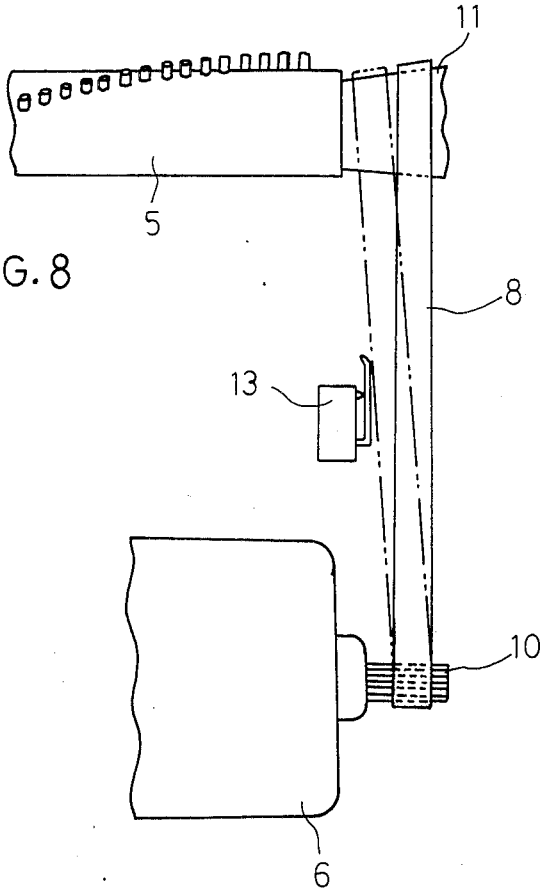
FIG. 8 is a view corresponding to FIG. 4 and showing still another embodiment.

FIG. 8 shows another embodiment in which the pulley 11 on the rotary brush 5 is tapered. If the belt 8 slips on the pulley 10 which is diametrically smaller in its entirety than the pulley 11, the belt 8 will not shift on the pulley 11 as contemplated when the rotary brush 5 becomes stalled, so that the pulley 10 is knurled to avoid slippage.

Figure 9:
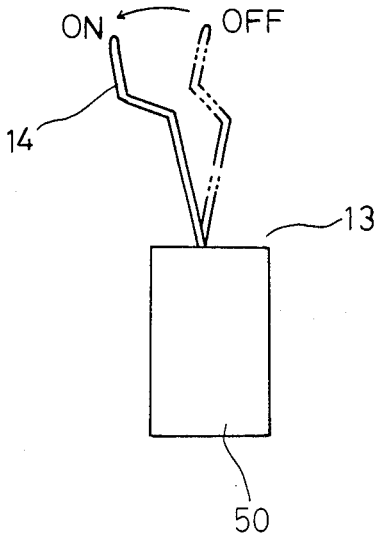
FIG. 9 is a plan view showing another example of stop switch.

FIG. 9 shows another example of stop witch 13 for the fan motor which has incorporated therein a snap action mechanism for the lever 14. The lever 14 is selectively lockable in an ON position indicated in solid line or in an OFF position indicated in broken line.

While the foregoing embodiments are of the type wherein the fan motor is used also for driving the rotary brush, a drive motor is provided specifically for the rotary brush in the cleaners of the type wherein the fan motor is disposed away from the intake opening portion as disclosed in Unexamined Japanese Patent Publication No. SHO 58-203733. The present invention is similarly applicable to such cleaners.

ADVANTAGES OF THE INVENTION

Because the vacuum cleaner of the present invention has the construction described above, the fan motor stopping means automatically functions when the rotary brush becomes stalled, enabling the user to eliminate the trouble suitably. Since the contemplated object can be achieved merely by using a tapered pulley and stopping means disposed in a specified position, the present cleaner is simple in construction, inexpensive and reliable in operation.

What is claimed is:

1. A vacuum cleaner comprising a dust intake portion, a rotary brush provided in the intake portion, a drive motor for driving the rotary brush, a fan motor for suction of dust, a dust collector for the dust taken in, a dust transfer passage extending from the intake portion to the dust collector, a rotary brush pulley, a drive motor pulley, a belt coupling the above mentioned two pulleys for transmitting the power of the drive motor, at least one of the pulleys being frustoconical, and drive motor stopping means disposed at one side of the belt toward which said one pulley is diametrically smaller and pushable by the belt when the belt is displaced.

2. A vacuum cleaner as defined in claim 1 wherein the frustoconical pulley has a taper of 4/25 to 5/25.

3. A vacuum cleaner as defined in claim 1 wherein the drive motor stopping means is a drive motor stop switch.

4. A vacuum cleaner as defined in claim 3 wherein the stop switch comprises a microswitch having a push portion and a metal lever for pushing the push portion of the microswitch by being pushed by the belt when the belt is displaced.

5. A vacuum cleaner as defined in claim 4 wherein the microswitch is protected by being converted with a diaphragm.

6. A vacuum cleaner as defined in claim 1 wherein the drive motor stopping means comprises a drive motor stop switch, lock means for the stop switch and release means for the lock means.

7. A vacuum cleaner as defined in claim 6 wherein the stop switch comprises a microswitch having a push portion and a metal lever for pushing the push portion by being pushed by the belt when the belt is displaced, the lock means being a magnet for attracting the metal lever thereto to hold the metal lever in pressing contact with the push portion, the release means being a re-start arm for pushing back the lever out of contact with the magnet.

8. A vacuum cleaner as defined in claim 1 wherein the drive motor stopping means comprises a switch for turning on an alarm lamp.

9. A vacuum cleaner as defined in claim 1 wherein the drive motor stopping means includes means for returning the belt from a displaced position.

10. A vacuum cleaner as defined in claim 9 wherein the belt returning means is a re-start arm for pushing back the belt from the displaced position.

11. A vacuum cleaner as defined in claim 10 wherein the re-start arm has a pivot so as to be pivotally movable, and the pivot is provided with a bearing portion integral with a holder for the drive motor.

12. A vacuum cleaner as defined in claim 1 wherein the fan motor serves also as the drive motor.

* * * * *